US005215807A

United States Patent [19]

Day et al.

[11] Patent Number: 5,215,807

[45] Date of Patent: Jun. 1, 1993

[54] FABRIC

[75] Inventors: Gerald F. Day, Derbyshire; Giles T. Gregory, Nottinghamshire, both of United Kingdom

[73] Assignee: General Motors Corporation, Detroit, Mich.

[21] Appl. No.: 838,896

[22] Filed: Feb. 21, 1992

[30] Foreign Application Priority Data

Feb. 28, 1991 [GB] United Kingdom ..... 9104211
Jul. 11, 1991 [GB] United Kingdom ..... 9115000

[51] Int. Cl.[5] ..... B32B 23/02

[52] U.S. Cl. ..... 428/193; 66/169 R; 66/170; 66/196; 66/198; 66/202; 428/57; 428/253

[58] Field of Search ..... 66/196, 198, 202, 169 R, 66/170; 428/193, 253, 229, 230, 57, 58

[56] References Cited

U.S. PATENT DOCUMENTS 4,755,242 7/1988 Miller et al. ..... 156/88

FOREIGN PATENT DOCUMENTS 0191193 8/1986 European Pat. Off. .
0361854 4/1990 European Pat. Off. .
2106928 5/1972 France .
1276185 6/1972 United Kingdom .
1308909 3/1973 United Kingdom .
1033144 6/1976 United Kingdom .
2168607 6/1986 United Kingdom .
2223034 3/1990 United Kingdom .

*Primary Examiner*—James J. Bell
*Attorney, Agent, or Firm*—Davis Hoxie Faithfull & Hapgood

[57] ABSTRACT

An upholstered three dimensional structure in which there is an upholstery fabric stretched over a three dimensional core, the fabric being formed by knitting and incorporating a sewn seam between the knitted fabric and a further fabric, the knitted fabric being provided with stable sewing zones which are less elastic than the majority of the remaining portions of the knitted fabric to assist in the sewing of the knitted fabric to a further fabric.

11 Claims, 4 Drawing Sheets

FABRIC

BACKGROUND OF THE INVENTION

1. Field of the Invention

This invention relates to fabrics and has particular reference to knitted fabric panels. It has further particular reference to knitted fabric panels intended for use in upholstered structures.

2. Description of Related Art

Proposals have been made, see UK patent application no. 2,223,034A, to produce upholstered structures such as upholstered three-dimensional car seats by knitting the entire fabric seat in one operation. This is a radical departure from conventional processes for making upholstered fabric structures wherein the fabric is manufactured by weaving. The woven structure is then cut into shapes and the shapes are stitched together.

The manufacture of upholstered structures by the use of woven fabric requires a number of distinct stages. First of all the yarn has to be formed into a warp and then the warp is transferred to a loom for weaving the fabric. The fabric will inevitably be in rectangular shape. The fabric is then cut into pieces and the pieces are sewn together to form the upholstered fabric for the upholstered structure. At each stage in the operation there are losses in yarn yield — the warp threads must be continuous and therefore there are losses associated with manufacturing the warp. The weaving operation involves further yarn loss and fabric is lost during the cutting operation. All told the total yield of yarn in the upholstered fabric compared to yarn in the bobbin state is no more than about 60% in the case of a vehicle seat. By knitting the upholstery fabric the yarn yields can be in the upper nineties percent. Furthermore, the knitting operation is a single operation requiring less manual input and less skill once the knitting machine has been set up.

In many cases, however, it is necessary to sew onto the knitted fabric of the upholstered structure. This is either because two knitted components have to be sewn together as it is not possible to knit the entire structure in one operation, or a knitted component has to be joined to a woven component.

British patent specification no. 1,276,185 describes the use of a thermoplastic resin filament which can be heated prior to knitting and becomes deformed during knitting. After knitting the entire structure becomes rigid once more.

British patent specification no. 1,214,939 describes a method of preventing the edge of a knitted fabric from unravelling by incorporating shrinking and adhering yarns in the edges.

U.S. Pat. No. 4,755,242 describes a knitted article such as a glove which incorporates a head shrunk multiple plastic yarn along the edge to prevent the edge unravelling.

Japanese Abstract No. 602755 further describes a trimmed edge fabric particularly for use in glove manufacture in which there is provided a shrinkable yarn at the free edge which is shrunk by heating.

British patent specification no. 2,223,034 describes the incorporation of a fusible yarn at the edge of a hem to prevent unravelling.

British patent specification no. 2,168,607 describes three dimensional trim cover assemblies but does not address the problems of sewing together such assemblies.

British patent specification no. 1,308,909 describes the formation of garment panels incorporating start-up courses into which are knitted elastomeric yarns shrunk on subsequent treatment. Such courses are, however, only set up courses for single jersey whole garment parts.

British patent specification no. 1,033,144 describes knitted fabrics for garments such as sweaters in which there is a stabilised free edge which is intended to be stable in the free condition.

European patent specification no. 361,854 describes the use of knitted joins in upholstery fabrics.

SUMMARY OF THE INVENTION

By the present invention there is provided an upholstered structure which comprises a knitted fabric panel in which there is included stable edges to ease the sewing of the fabric panel to other fabrics.

The stable edge may be provided by a contractile thread, an inherently resilient thread which is stretched by an amount in excess of 50% of its rest length when knitted into the panel. The contractile thread may be a thread which shrinks on the application of an external stimulus, such as heat. The contractile thread may incorporate an inherently resilient thread and a shrinking component. The shrinking component may be fusible at temperatures below 150° C., and preferably is fusible at temperatures below 100° C.

The fabric may be weft knitted.

The fabric may be a double jersey fabric and may be knitted on a flat V-bed machine. The fabric may be knitted without pull-down, and may be knitted on a presser foot machine. The contractile thread may be included in some or all of the final and/or initial fourteen courses of the fabric, or may be included in some or all of the final and/or initial two to twelve courses. The contractile thread may be incorporated in both the initial and final ten courses of the fabric or in both the initial and final two to ten courses of the fabric. The contractile thread may be included in the initial and/or final 2 cm of fabric, or 1.5 cm or 1 cm of fabric.

In the double jersey knitted structure, the contractile thread may be knitted predominantly onto the reverse side of the fabric if the face side is to be visible in use. The contractile thread may contract to such an extent that, after the knitted fabric has been stretched in a wale-wise direction after knitting, the length of one edge is substantially the same as the width of the fabric along the courses away from the edge, with no significant puckering of the edge.

The present invention further provides a knitted fabric panel for use in an upholstered three-dimensional structure, in which the fabric panel has an edge portion in which the knitted structure is stabilised against stretching so that the elasticity of the edge portion is less than the elasticity of the central portion of the knitted fabric panel.

The present invention further provides an upholstered three-dimensional structure in which the upholstery fabric is stretched over a three-dimensional core and the fabric is formed by knitting, in which there is a sewn seam between the knitted fabric and a further portion of fabric, and in which the edge portion of the knitted fabric is less elastic than the majority of the remaining portions of the knitted fabric so as to form a stable sewing zone along the edge of the knitted fabric to be sewn.

The fabric may be a double jersey fabric, the less elastic sewing zones being in the form of a pair of single jersey layers. The single jersey layers may be 1×1 cross-miss single jersey. There may be 32 to 64, preferably 40 to 56 further preferably 48 courses of single jersey. The single jersey may be knitted by knitting on a knitting machine having a pair of opposed needle beds and by knitting a first course on every alternate needle on one bed, a second course on the other needles on the same bed, a third course on every alternate needle on the second bed and a fourth course on the other needles on the second bed. This produces a four course repeat of 1×1 cross-miss single jersey. Preferably this four course repeat is knitted twelve times to give 48 courses in all.

The further portion of fabric may be a woven fabric or vinyl fabric or bonded vinyl. The upholstery fabric may be weft knitted. The further portion of fabric may be warp knitted.

The present invention yet further provides a knitted fabric panel for use in an upholstered three-dimensional structure, in which the knitted fabric is knitted on a flat V-bed machine without take-down, and in which the fabric is stretched in a wale-wise direction after knitting and before being applied to the three-dimensional core to form the structure, in which the stitch density at the edges of the fabric in a course-wise direction is the same as or greater than the course-wise stitch density in the main body of the panel.

The sewing zone at the edge of the knitted structure may be provided by knitting on the reverse side of the fabric a fusible thread such that the fusible thread knits on every alternate reverse-side needle or knits on two needles out of three on the reverse side, the thread forming the front of the fabric knitting on the alternate reverse-side needle or on the remaining one in three of the alternate reverse needles as well as on the front needles.

The present invention further provides the provision of an anti-ladder edge formed at the uppermost or final edge of the fabric and produced by knitting both the front and back of the double jersey layer with a contractile thread for at least the last course, and preferably for the final two courses.

BRIEF DESCRIPTION OF THE DRAWINGS

Embodiments of the present invention will now be described with reference to the accompanying drawings, of which.

DESCRIPTION OF THE PREFERRED EMBODIMENTS

Figure 1:
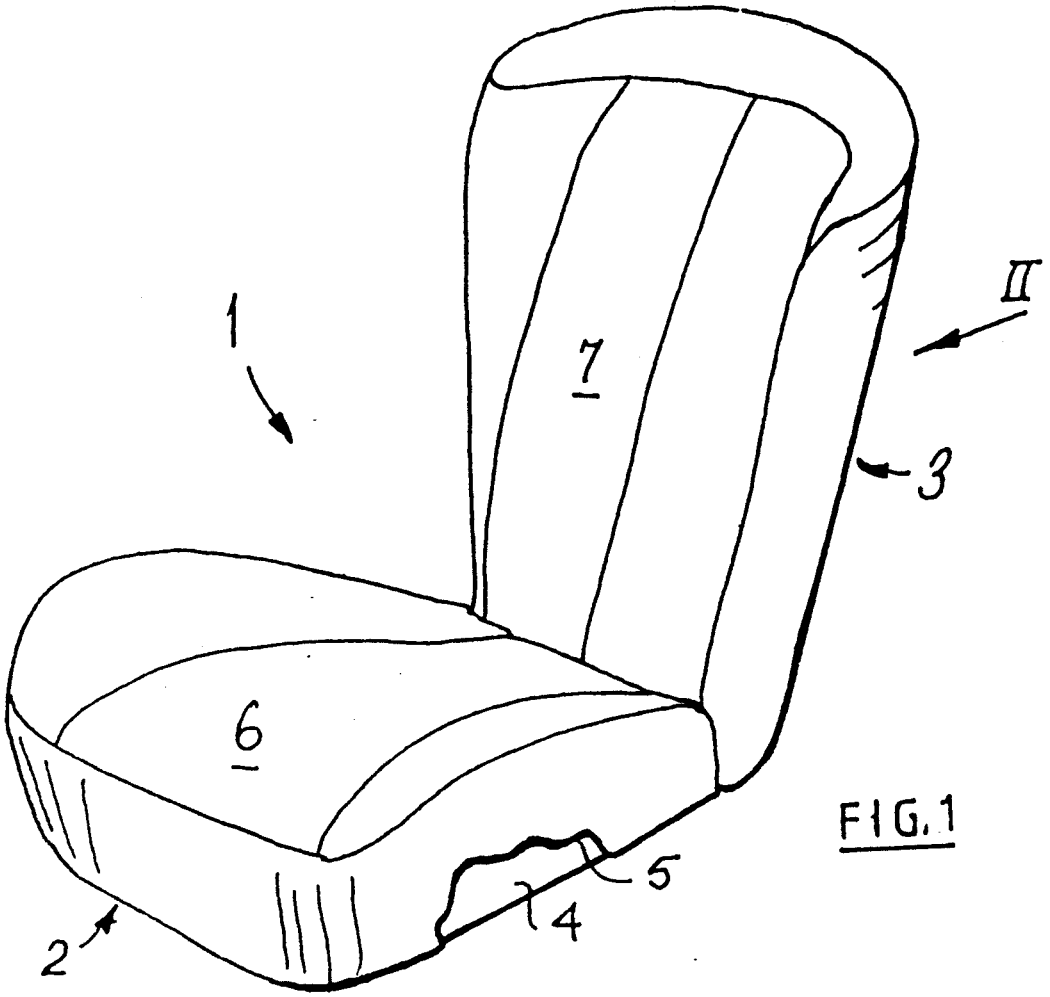
FIG. 1 is a perspective view of an upholstered vehicle seat.

Referring to FIG. 1, this shows an upholstered vehicle seat indicated generally by 1. The seat comprises a base cushion indicated generally by 2 and a back indicated generally by 3. The upholstered three-dimensional structure essentially comprises a core 4, shown behind the broken-away portion 5 of the base cushion 2, covered with a fabric upholstered cover 6. The fabric cover 6 may be knitted in one piece as is described in British patent specification no. 2,223,034A referred to above.

Figure 2:
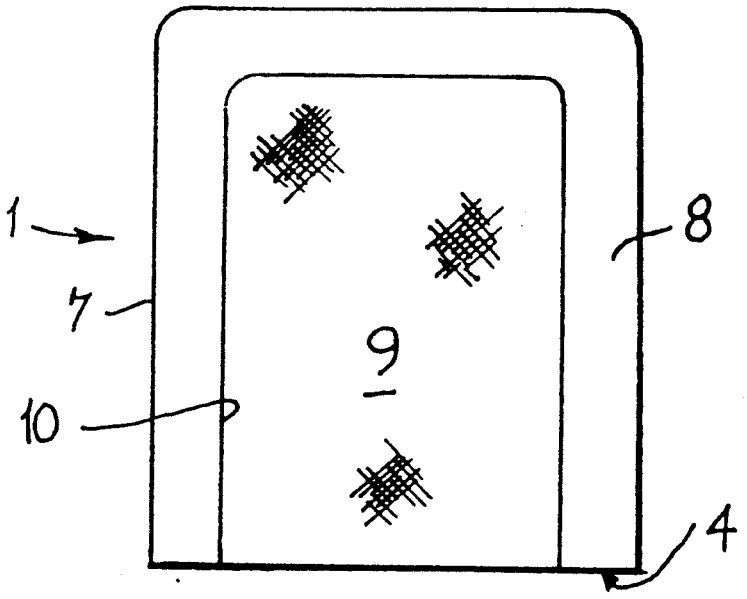
FIG. 2 is a view of the back of the seat of FIG. 1 along the line of arrow II.

The back 3 of the seat incorporates a knitted cover 7, but it is not practicable to knit a tube in double jersey structure on a flat V-bed machine. It is practicable to knit tubes into double jersey structures but the tubes then are of single jersey formation. In order to provide an aesthetically pleasing back, therefore, it is necessary to form the cover 7 with integral edge portions 8 (FIG. 2) and to sew a further fabric panel 9 to the cover 7,8 along the line 10.

A convenient way of producing the panel 9 is to knit the panel on a flat V-bed knitting machine. Typically the panel 9 would be knitted on the same or a similar machine as is used to knit the fabric covers 6 and 7. Further typically the fabric panel 9 would be knitted on a machine which does not include take-down such as a presser foot machine. Typically, after knitting, it is found that the fabric panel 9 has the shape shown in FIG. 3, because of the lack of take-down associated with presser foot knitting the fabric panel is compressed in the wale-wise direction 11. To produce the correct shape of panel, therefore, the fabric is stretched to adopt the shape shown in FIG. 4. Essentially, by increasing the length of the panel 9 in the wale-wise direction 11 there is a shrinkage of the panel in the course-wise direction 12. However, because the edges of the panel have to be held, to permit the panel to be stretched, it is found that the edges 13 and 14 are not stretched as much as the centre of the panel and, therefore, the edges 13 and 14 tend to pucker. This means that it can be very difficult to sew the panel 9 into the back of the seat as the edges 13,14 are too long for the aperture into which they are to be sewn. Furthermore, the edges 13,14, being little stretched, are very elastic and this increases the problem of sewing the fabric portion 9 into the upholstered structure.

The problem of the unstable sewing zone and the excessively puckered edge are resolved by the incorporation of a contractile thread in accordance with the invention.

Figure 5:
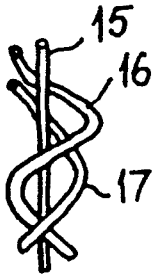
FIG. 5 is a contractile thread construction in enlarged view.

The particular preferred form of contractile yarn is a three component yarn, comprising an elastomeric core 15 around which are wrapped a polyester coloured member 16 and a fusible thread element 17 (FIG. 5). However, if required, the polyester element 16 could be combined either with the fusible element 17 alone or the elastomeric element 15 (such as 'Lycra' Registered Trade Mark) alone or with a heat shrinkable component.

Figure 6:
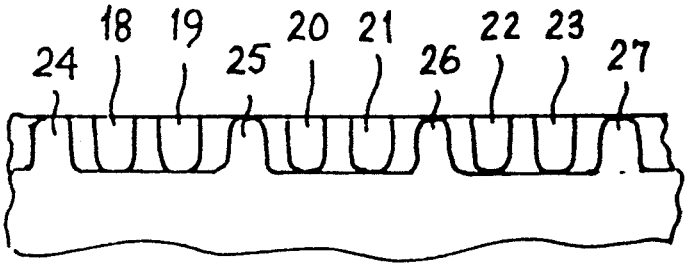
FIGS. 6 and 7 are detailed edge views of a fabric in accordance with the present invention.

The panel 9 is knitted on a flat V-bed machine and is of double jersey construction. The final twelve courses of the panel 9 are knitted with the contractile thread knitting principally on the back face of the double jersey structure. This results in a back face substantially as illustrated in FIG. 6 having the contractile elements formed in wales 18 to 23. The conventional polyester yarn forms the wales 24 to 27. From the front face of the fabric the wales appear principally to be formed of polyester with an occasional small amount of contractile yarn being visible at locations 28,29,30 and 31. The stitch structure which produces the visible structure of FIG. 6 and 7 is illustrated in FIG. 8.

The upper layer of needles 32 form the reverse side of the fabric and the lower layer of needles 33 produce the face of the fabric. The contractile thread is shown at 34 and the normal polyester thread is shown at 35. It can be seen that the polyester thread knits on all of the front face needles 33 and on one in three of the rear face needles 32. The contractile thread 34 knits on two in three of the rear face needles.

Figure 4:
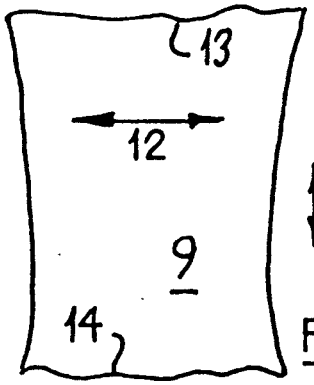
FIG. 4 is a view of the panel of FIG. 3 after stretching without incorporating the present invention.

After the knitting has been completed and the fabric is stretched, the contractile thread 34 pulls the edge tight and prevents the puckering which can be seen at 13,14 in FIG. 4. The contractile thread may work simply by the contraction of the elastomeric component 15 — which is extended by more than 50% during the knitting procedure and which then simply acts as an elastic "spring" — or the contraction may be more permanently effected by heating the heat shrinkable or the fusible component 17. Typically the heating operation would be carried out by steaming the fabric.

Figure 7:
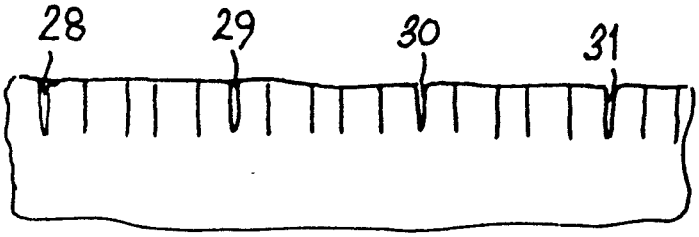
Figure 8:
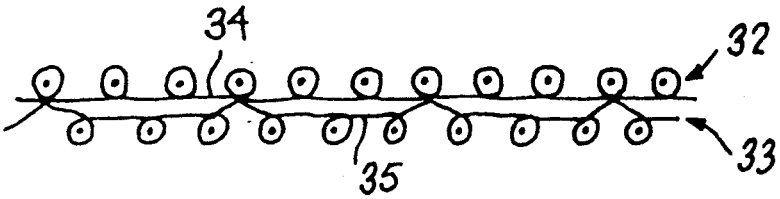
FIG. 8 is a stitch diagram of the fabric edge of FIG. 7, FIGS. 9*a*, 9*b* and 9*c* are computer generated stitch diagrams showing in more detail the structure illustrated in FIG. 8, FIGS. 10*a* to 10*e* are computer generated stitch diagrams of a lower-contraction edge structure.
Figure 9A:
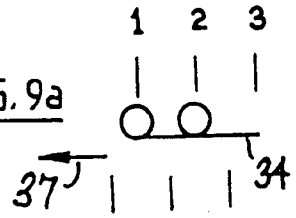
Figure 9B:
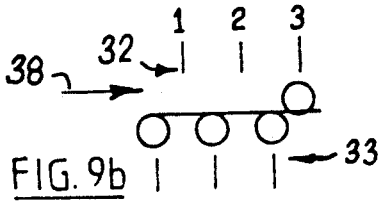
Figure 9C:
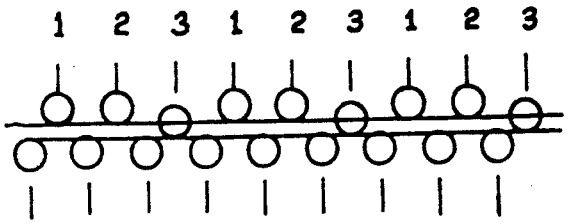

The formation of the edge shown in FIG. 6 and 7 is more clearly understood with reference to FIGS. 9*a* to 9*c*. These are computer generated stitch diagrams, and it will be seen that FIG. 9*c* is effectively the same as FIG. 8. However, from FIG. 8 it will be appreciated that the portions 28 to 31 showing on the front face of the fabric correspond to the small portions of the contractile thread which can be seen on the face side of the needles as shown in FIG. 8. This cannot be seen as clearly in the computer generated stitch diagrams, FIG. 9*a* to 9*c*.

The contractile thread 34 is knitted onto the upper bed of needles numbers 1 and 2 when the thread carrier is moved in the direction of the arrow 37, i.e. from right to left. When the thread carrier is moved in the opposite direction i.e. from left to right in the direction of arrow 38, a polyester thread 35 is knitted on all of the face needles 33 and also on needle number 3 on the back needles 32. Combining these two layers of knitting together as is shown in FIG. 9*c* produces the highly contractile edge structure of FIGS. 6 to 8.

Figure 10A:
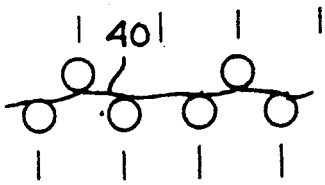
Figure 10B:
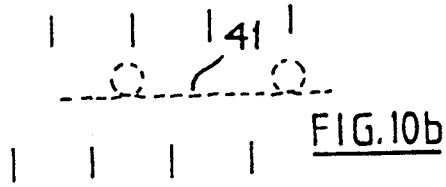
Figure 10C:
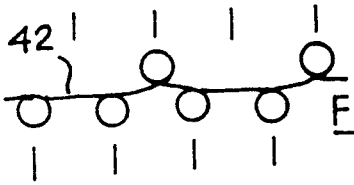
Figure 10D:
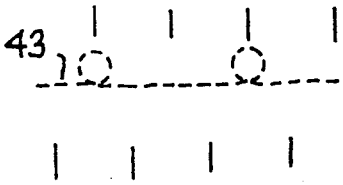

A slightly less contractile edge structure can be produced by knitting the contractile thread on every other of the reverse needles 32. Such a structure is shown in FIGS. 10*a* to 10*e*. The structure shown in FIGS. 10*a* to 10*d* show the structure knitted in four successive courses. In FIG. 10*a* a polyester yarn 40 is knitted onto all of the front needles and is knitted only on every alternate back needle. In the next course a fusible thread 41 is knitted on the back needles on the other alternative needles as is shown in FIG. 10*b*. The fusible thread is not knitted on any of the front needles. In the third course of the four course sequence, the polyester thread 42 knits on all of the front needles and on the same reverse needles as the thread 41, as is shown in FIG. 10*c*. In the final course of the sequence, shown in FIG. 10*d*, the contractile thread 43 is knitted only on the back needles, on the needles not knitted on by the thread 42.

Figure 10E:
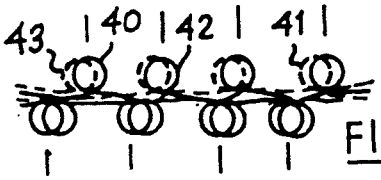

Overall, therefore, the structure illustrated in FIG. 10*e* is produced in which the contractile threads are knitted only on the back needles, and the polyester yarns are knitted on all of the front needles and on alternate needles on the back of the bed. For ease of identification, the polyester yarns in FIGS. 10*a*–10*e* have been shown by solid lines and the contractile threads by dotted lines.

Figure 11A:
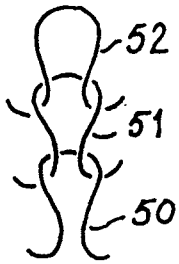
FIGS. 11*a* and 11*b* are knitted loops before and after shrinking.
Figure 11B:
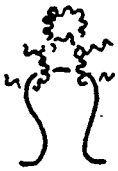

The contractile thread may be knitted on all of the needles for the final two courses. This results in the structure shown in FIGS. 11*a* and 11*b* before and after relaxation of the contractile thread. As shown in FIG. 11*a* the course of loops 50 is formed of conventional polyester material, whereas the courses 51 and 52 are formed of the contractile thread. After knitting has been complete and the threads have been fully contracted the structure shown in FIG. 11*b* is produced in which the loops 51 and 52 are so entangled as to be almost unpickable. This means that the edges are extremely unlikely to ladder.

Figures 12A, 12B, 12C, 12D:
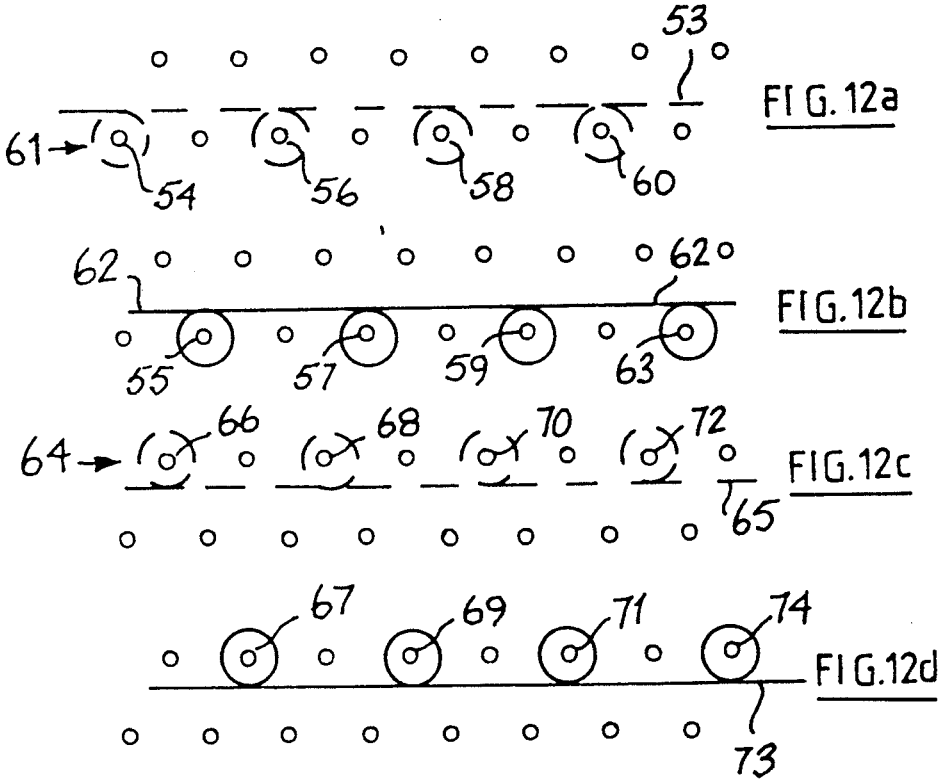
FIGS. 12*a* to 12*d* are computer generated stitch diagrams of an alternate stable edge structure.

FIGS. 12*a* to 12*d* show a two colour four course repeat which forms a very stable sew edge for the double jersey fabric. Because double jersey fabrics incorporate a thread interconnecting the two layers of jersey fabric, the fabric has a certain extensibility. Single jersey fabric is less extensible than double jersey fabrics when extended along the line of the courses. Essentially, therefore, the structure illustrated in FIGS. 12*a* to 12*d* produces a pair of single jersey layers which form a very stable sewing edge. Before knitting the structure shown in FIGS. 12*a* to 12*d* there would be knitted a set up course. After the set up course, the first course knitted would be as illustrated in FIG. 12*a*. A polyester yarn 53 in one colour is knitted on every alternate needle 54, 56, 58 and 60 on the first needle bed indicated generally by 61. The knitting illustrated in FIG. 12*a* is in fact a 1×1 cross-miss single jersey structure. The second course of knitting may be knitted in a second colour by the second cams in a double system cam box and as illustrated in FIG. 12*b* a polyester thread 62 in the second colour is knitted on the alternate needles 55, 57, 59 and 63 of the first bed. The third course to be knitted is illustrated in FIG. 12*c*.

In the third course, knitting takes place only on the second bed 64 and a polyester thread 65 of the same colour as thread 53 is knitted on needles 66, 68, 70 and 72. The fourth course of the sequence is illustrated in FIG. 12*d*, in this case a thread 73 of the same colour as thread 62 is knitted on needles 67, 69, 71 and 74 of the second bed by the second set of cams in the double system cam box. This four course structure 12*a* to 12*d* is then repeated a further 11 times. This produces a pair of single jersey layers which are not connected to one another. Each layer is a 1×1 cross-miss single jersey layer. The knitting then continues as double jersey for the main portion of the upholstery cover. Effectively, therefore, at the beginning of the knitting there is produced a structure comprising a tubular portion followed by a double jersey portion. Because the tubular portion is of single jersey structure it is less extensible than the double jersey structure. Furthermore, because the structure is formed of cross-miss single jersey stitches it is even less extensible than would be the case if the single jersey structure were to be produced by knitting on every needle on each course.

After the main body of the upholstery has been produced in principally double jersey structure, again the fabric is knitted using the structures shown in FIGS. 12*a* to 12*d*. Thus at the end of knitting, the four course repeat structure shown in FIGS. 12*a* to 12*d* is repeated 12 times in all to give a further pair of single jersey layers. Finally, the contractile or fusible thread is knitted to join the two single jersey layers together and the fabric structure is pressed off from the machine. After pressing off, the fabric structure is heated to cause the fusible or contractile threads to contract as is shown in FIGS. 11*a* and 11*b*.

This stable sewing edge may, therefore, be produced in 100 per cent polyester, preferably the air textured polyester yarns which are used to form the body of the double jersey upholstered structure.

For cosmetic or aesthetic reasons the first two courses of stitches at the beginning of knitting may also be formed wholly of contractile threads so that the upper and lower portions of the knitted fabric are identical, although it will be appreciated that fabrics will not normally run when unpicked from the first course of knitting.

Figure 3:
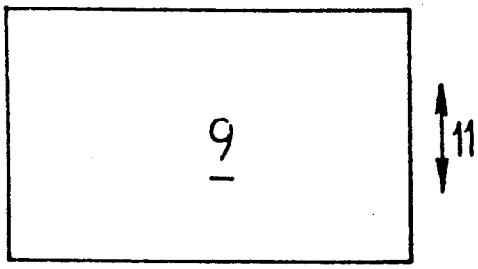
FIG. 3 is a view of a centre panel of FIG. 2 after knitting.

The present invention therefore provides a stable edge zone which has a higher stitch density, in the preferred condition, in the edge compared to the centre of the fabric after the fabric has been stretched and allowed to relax. It will be appreciated that if the fabric is knitted as a simple rectangle, as shown in FIG. 3, the edges of the fabric at the beginning and end of the knitted panel will, with the present invention, be of slightly less length after the contractile thread has contracted than the width of the fabric in the centre region of the panel. However, if a panel is knitted which is itself shaped, the edges may deliberately be of different length at the beginning and end of the panels compared to the central region of the panel. However, by providing a substantially greater stitch density the panels will be substantially even in the post contracted state and will incorporate a relatively inflexible stable sewing zone on their sewing edges.

Typical materials for the contractile shrinking thread element would be a polypropylene or a polyamide which is affected by the steam used to steam set the fabric and to produce the shrinking of the contractile thread.

The stable sewing zone may be provided on both of two components to be sewn together if both are formed of an unstable knitted structure. Thus a stable sewing zone may be knitted into the edge 8 of the cover 7 where it is sewn to the back panel 9. In some cases, the stable sewing zone need only be provided on the sewing edge of the knitted cover 7, for example where the back panel 9 is of woven construction, or where a knitted panel is provided which has been produced on a warp knitting machine as a stable structure which has been stentered, and then provided with a bonded backing such as a bonded scrim.

What is claimed is:

1. In an upholstered three-dimensional structure having an upholstery fabric stretched over a three-dimensional core, the fabric is formed by knitting, in which there is a sewn seam between the knitted fabric and a further portion of fabric, the improvement of making the edge portion of the knitted fabric less elastic than the majority of the remaining portions of the knitted fabric so as to form a stable sewing zone along the edge of the knitted fabric to be sewn.

2. A structure as claimed in claim 1 in which the fabric is a double jersey fabric.

3. A structure as claimed in claim 2 in which the less elastic edge portion is in the form of a pair of single jersey layers.

4. A structure as claimed in claim 3 in which the single jersey layers are $1 \times 1$ cross-miss single jersey.

5. A structure as claimed in claim 4 in which the single jersey layers extend over a plurality of courses of the knitted fabric, the number of courses being selected from the group consisting of 32 to 64 courses, 40 to 56 courses and 48 courses of single jersey.

6. A structure as claimed in claim 4 in which the single jersey layers are knitted by knitting on a knitting machine having a pair of opposed needle beds, and by knitting a first course on every alternate needle on one bed, a second course on the other needles on the same bed, a third course on every alternate needle on the second bed and a fourth course on the other needles on the second bed.

7. A structure as claimed in claim 5 in which the single jersey layers are knitted by knitting on a knitting machine having a pair of opposed needle beds, and by knitting a first course on every alternate needle on one bed, a second course on the other needles on the same bed, a third course on every alternate needle on the second bed and a fourth course on the other needles on the second bed.

8. A structure as claimed in claim 2 in which the fabric is knitted upon a knitting machine having a pair of opposed needle beds without take-down, and in which the fabric is stretched in a wale-wise direction after knitting and before being applied to the three dimensional core to form the structure, in which the stitch density at the edges of the fabric in a course-wise direction is the same as or greater than the course-wise stitch density in the main body of the panel

9. A structure as claimed in claim 2 in which the sewing zone is provided by knitting on the reverse side of the fabric a fusible thread.

10. A structure as claimed in claim 9 in which the fabric is knitted on a knitting machine having opposed needle beds, the fusible thread being knitted on every alternate reverse-side needle or is knitted on two out of three reverse side needles, the thread forming the front of the fabric being knitted on all of the front needles and on those reverse needles not being knitted upon by the fusible thread.

11. A structure as claimed in claim 1 in which the further portion of fabric is chosen from the group consisting of woven fabric, vinyl fabric and bonded vinyl.

* * * * *